US006715450B1

(12) United States Patent
Wittchow

(10) Patent No.: US 6,715,450 B1
(45) Date of Patent: Apr. 6, 2004

(54) FOSSIL-FUEL FIRED CONTINUOUS-FLOW STEAM GENERATOR

(75) Inventor: Eberhard Wittchow, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/937,828

(22) PCT Filed: Mar. 20, 2000

(86) PCT No.: PCT/DE00/00865

§ 371 (c)(1),
(2), (4) Date: Sep. 28, 2001

(87) PCT Pub. No.: WO00/60283

PCT Pub. Date: Oct. 12, 2000

(30) Foreign Application Priority Data

Mar. 31, 1999 (DE) ..... 199 14 760

(51) Int. Cl.[7] ..... F22B 33/00

(52) U.S. Cl. ..... 122/1 B; 122/7 R; 122/235.12; 122/406.4; 122/DIG. 4

(58) Field of Search ..... 122/1 B, 451 S, 122/479.7, 406.4, DIG. 4, 7 R, 235.12

(56) References Cited

U.S. PATENT DOCUMENTS 3,003,479 A * 10/1961 Bock et al. ..... 122/1 B
3,043,279 A 7/1962 Blomquist
3,527,261 A 9/1970 Bigler et al.
4,987,862 A * 1/1991 Wittchow et al. ..... 122/235.12
5,560,322 A * 10/1996 Fitzgerald ..... 122/235.11
5,662,070 A * 9/1997 Kastner et al. ..... 122/6 A
6,557,499 B2 * 5/2003 Franke et al. ..... 122/1 B

FOREIGN PATENT DOCUMENTS

WO A1-9964787 12/1999

OTHER PUBLICATIONS

Franke et al. VGB Kratwekstechnick, vol. 73, No. 4, pp. 352–361 (1993).

* cited by examiner

*Primary Examiner*—Jiping Lu
(74) *Attorney, Agent, or Firm*—Harness, Dickey & Pierce, P.L.C.

(57) ABSTRACT

A continuous-flow steam generator includes a combustion chamber with evaporator tubes for fossil fuel. The combustion chamber is followed on the fuel-gas side, via a horizontal gas flue, by a vertical gas flue. When the continuous-flow steam generator is in operation, temperature differences between the exit region of the combustion chamber and the entry region of the horizontal gas flue are to be particularly low. For this purpose, of a plurality of evaporator tubes capable of being acted upon in parallel by a flow medium, a number of the evaporator tubes are led through the combustion chamber before their entry into the containment wall of said combustion chamber.

33 Claims, 5 Drawing Sheets

FOSSIL-FUEL FIRED CONTINUOUS-FLOW STEAM GENERATOR

This application is the national phase under 35 U.S.C. §371 of PCT International Application No. PCT/DE00/00865 which has an International filing date of Mar. 20, 2000, which designated the United States of America, the entire contents of which are hereby incorporated by reference.

FIELD OF THE INVENTION

The invention relates to a continuous-flow steam generator having a combustion chamber for fossil fuel which is followed on the fuel-gas side, via a horizontal gas flue, by a vertical gas flue, the containment walls of the combustion chamber being formed from vertically arranged evaporator tubes welded to one another in a gastight manner.

BACKGROUND OF THE INVENTION

In a power plant with a steam generator, the energy content of a fuel is utilized for the evaporation of a flow medium in the steam generator. In this case, the flow medium is conventionally carried in an evaporator circuit. The steam supplied by the steam generator may, in turn, be provided, for example, for driving a steam turbine and/or for a connected external process. When the steam drives a steam turbine, a generator or a working machine is normally operated via the turbine shaft of the steam turbine. Where a generator is concerned, the current generated by the generator may be provided for feeding into an interconnected and/or island network.

The steam generator may in this case be designed as a continuous-flow steam generator. A continuous-flow steam generator is known from the paper "Verdampferkonzepte für Benson-Dampferzeuger" ["Evaporator concepts for Benson steam generators"] by J. Franke, W. Köhler and E. Wittchow, published in VGB Kraftwerkstechnik 73 (1993), number 4, p. 352–360. In a continuous-flow steam generator, the heating of steam generator tubes provided as evaporator tubes leads to an evaporation of the flow medium in the steam generator tubes in a single pass.

Continuous-flow steam generators are conventionally designed with a combustion chamber in a vertical form of construction. This means that the combustion chamber is designed for the heating medium or fuel gas to flow through it in approximately vertical direction. In this case, the combustion chamber may be followed on the fuel-gas side by a horizontal gas flue, a deflection of the fuel-gas stream into an approximately horizontal direction of flow taking place at the transition from the combustion chamber into the horizontal gas flue. However, because of the thermally induced changes in length of the combustion chamber, combustion chambers of this type generally require a framework on which the combustion chamber is suspended. This necessitates a considerable technical outlay in terms of the manufacture and assembly of the continuous-flow steam generator. The higher the outlay, the greater the overall height of the continuous-flow steam generator. This applies particularly in the case of continuous-flow steam generators which are designed for a steam power output of more than 80 kg/s under full load.

A continuous-flow steam generator is not subject to any pressure limitation, so that fresh-steam pressures well above the critical pressure of water ($p_{cri}$=221 bar), where there is only a slight difference in density between a liquid-like and a vapor-like medium, are possible. A high fresh-steam pressure is conducive to high thermal efficiency and therefore to low $CO_2$ emissions for a fossil-fired power station which, for example, can be fired with hard coal or else with lignite in solid form as fuel.

A particular problem is presented by the design of the containment wall of the gas flue or combustion chamber of the continuous-flow steam generator in terms of the tube-wall or material temperatures which occur there. In the subcritical pressure range to about 200 bar, the temperature of the containment wall of the combustion chamber is determined essentially by the height of the saturation temperature of water when wetting of the inner surface of the evaporator tubes can be ensured. This is achieved, for example, using evaporator tubes which have a surface structure on their inside. In this respect, in particular, internally ribbed evaporator tubes come under consideration, of which the use in a continuous-flow steam generator is known, for example, from the abovementioned paper. These so-called ribbed tubes, that is to say tubes with a ribbed inner surface, have particularly good heat transmission from the tube inner wall to the flow medium.

Experience has shown that it is not possible to avoid the situation where, when the continuous-flow steam generator is in operation, thermal stresses occur between adjacent tube walls of different temperature when these are welded to one another. This is the case, in particular, with regard to the portion of the combustion chamber connecting the latter to the horizontal gas flue following it, that is to say between the evaporator tubes of the exit region of the combustion chamber and the steam generator tubes of the entry region of the horizontal gas flue. These thermal stresses may markedly reduce the useful life of the continuous-flow steam generator and, in an extreme case, even give rise to tube fractures.

SUMMARY OF THE INVENTION

An object on which the invention is based is, therefore, to specify a fossil-fired continuous-flow steam generator of the abovementioned type which requires a particularly low outlay in terms of manufacture and assembly. Moreover, preferably a generator during the operation of which temperature differences at the connection of the combustion chamber to the horizontal gas flue following the latter are kept low. This is to be the case, in particular, for the mutually directly or indirectly adjacent evaporator tubes of the combustion chamber and steam generator tubes of the horizontal gas flue following the combustion chamber.

This object and/or other objects are achieved, according to the invention, in that the continuous-flow steam generator has a combustion chamber with a number of burners arranged level with the horizontal gas flue. A plurality of the evaporator tubes are preferably capable of being acted upon in each case in parallel by flow medium. Further, in the exit region of the combustion chamber, a number of the evaporator tubes are preferably capable of being acted upon in parallel by flow medium being led through the combustion chamber before their entry into the respective containment wall of the combustion chamber.

The invention proceeds from the notion that a continuous-flow steam generator capable of being produced at a particularly low outlay in terms of manufacture and assembly, should have a suspension structure capable of being executed by simple means. A framework to be produced at comparatively low outlay in technical terms and intended for suspending the combustion chamber may, in this case, be accompanied by a particularly small overall height of the continuous-flow steam generator. A particularly small overall height of the continuous-flow steam generator can be achieved by the combustion chamber being designed in a horizontal form of construction. For this purpose, the burners are arranged level with the horizontal gas flue in the combustion chamber wall. Thus, when the continuous-flow steam generator is in operation, the fuel gas flows through the combustion chamber in an approximately horizontal main direction of flow.

Moreover, when the continuous-flow steam generator with the horizontal combustion chamber is in operation, temperature differences should be particularly low at the connection of the combustion chamber to the horizontal gas flue, in order reliably to avoid premature material fatigues as a result of thermal stresses. These temperature differences should be especially low, in particular, between mutually directly or indirectly adjacent evaporator tubes of the combustion chamber and steam generator tubes of the horizontal gas flue, so that material fatigues as a result of thermal stresses are prevented particularly reliably in the exit region of the combustion chamber and in the entry region of the horizontal gas flue.

However, when the continuous-flow steam generator is in operation, that entry portion of the evaporator tubes which is acted upon by flow medium has a comparatively lower temperature than the entry portion of the steam generator tubes of the horizontal gas flue following the combustion chamber. To be precise, comparatively cold flow medium enters the evaporator tubes,in contrast to the hot flow medium which enters the steam generator tubes of the horizontal gas flue. Hence, when the continuous-flow steam generator is in operation, the evaporator tubes in the entry portion are colder than the steam generator tubes in the entry portion of the horizontal gas flue. Material fatigues as a result of thermal stresses are therefore to be expected at the connection between the combustion chamber and the horizontal gas flue.

If, however, preheated flow medium, instead of cold, enters the evaporator tubes of the combustion chamber, the temperature difference between the entry portion of the evaporator tubes and the entry portion of the steam generator tubes will also no longer be as great as would be the case if cold flow medium were to enter the evaporator tubes. The temperature difference can be reduced even further if the tube in which the preheating of the flow medium takes place by heating is connected directly to or else forms part of the evaporator tube connected indirectly or directly to the steam generator tubes of the horizontal gas flue. For this purpose, a number of the evaporator tubes are led through the combustion chamber before their entry into the containment wall of the combustion chamber. At the same time, this number of evaporator tubes are assigned to a plurality of evaporator tubes capable of being acted upon in parallel by flow medium.

The side walls of the horizontal gas flue and/or of the vertical gas flue are advantageously formed from vertically arranged steam generator tubes welded to one another in a gastight manner and capable of being acted upon in each case in parallel by flow medium.

Advantageously, in each case, a number of parallel-connected evaporator tubes of the combustion chamber are preceded by a common entry header system and followed by a common exit header system for flow medium. To be precise, a continuous-flow steam generator designed in this configuration makes it possible to have reliable pressure compensation between a number of evaporator tubes capable of being acted upon in parallel by flow medium, so that, in each case, all the parallel-connected evaporator tubes between the entry header system and the exit header system have the same overall pressure loss. This means that the throughput must rise in the case of an evaporator tube heated to a greater extent, as compared with an evaporator tube heated to a lesser extent. This also applies to the steam generator tubes of the horizontal gas flue or of the vertical gas flue which are capable of being acted upon in parallel by a flow medium and which are advantageously preceded by a common entry header system for flow medium and followed by a common exit header system for flow medium.

The evaporator tubes of the end wall of the combustion chamber are advantageously capable of being acted upon in parallel by flow medium and precede on the flow-medium side the evaporator tubes of the containment walls which form the side walls of the combustion chamber. This ensures a particularly beneficial cooling of the highly heated end wall of the combustion chamber.

In a further advantageous embodiment of the invention, the tube inside diameter of a number of the evaporator tubes of the combustion chamber is preferably selected as a function of the respective position of the evaporator tube in the combustion chamber. Evaporator tubes in the combustion chamber can thereby be adapted to a heating profile capable of being predetermined on the fuel-gas side. As a result of the influence brought about thereby on the throughflow of the evaporator tubes, temperature differences of the flow medium at the exit from the evaporator tubes of the combustion chamber are kept particularly low in a particularly reliable way.

For particularly good transmission of heat from the heat of the combustion chamber to the flow medium carried in the evaporator tubes a number of the evaporator tubes preferably and advantageously have on their inside, in each case, ribs forming a multiflight thread. In this case, advantageously, a pitch angle $\alpha$ between a plane perpendicular to the tube axis and the flanks of the ribs arranged on the tube inside is preferably smaller than about 60°, even more preferably smaller than about 55°.

To be precise, in a heated evaporator tube designed as an evaporator tube without internal ribbing, a so-called smooth tube, from a specific steam content on, the wetting of the tube wall necessary for a particularly good heat transmission can no longer be maintained. In the absence of wetting, the tube wall may be dry in places. The transition to a dry wall of this kind leads to what is known as a heat transmission crisis with an impaired heat transmission behavior. Therefore, in general, the tube wall temperatures at this point rise particularly sharply.

In an internally ribbed evaporator tube, however, as compared with a smooth tube, this heat transmission crisis arises only at a steam mass content of >0.9, that is to say just before the end of the evaporation. This is attributable to the swirl which the spiral ribs impart to the flow. On account of the difference in centrifugal force, the water fraction is separated from the steam fraction and is transported to the tube wall. The wetting of the tube wall is thereby maintained up to high steam contents, so that there are even high flow velocities at the location of the heat transmission crisis. This gives rise, despite the heat transmission crisis, to a relatively good heat transmission and, as a result, to low tube wall temperatures.

A number of the evaporator tubes of the combustion chamber advantageously have means for reducing the throughflow of the flow medium. In this case, it proves particularly beneficial if the means are preferably designed as throttle devices. Throttle devices may be, for example, fittings which are installed in the evaporator tubes and which reduce the tube inside diameter at a point within the respective evaporator tube. It also proves advantageous, in this case, to have means for reducing the throughflow in a line system which comprises a plurality of parallel lines and through which flow medium can be supplied to the evaporator tubes of the combustion chamber. At the same time, the line system may also precede an entry header system of evaporator tubes capable of being acted upon in parallel by flow medium. In this case, for example, throttle accouterments may be provided in one line or in a plurality of lines of the line system. By such means for reducing the throughflow of the flow medium through the evaporator tubes, it is possible for the throughput of the flow medium through individual evaporator tubes to be adapted to their respective heating in the combustion chamber. Temperature differences of the flow medium at the exit of the evaporator tubes are thereby additionally kept particularly low in a particularly reliable way.

Adjacent evaporator or steam generator tubes are preferably welded to one another in a gastight manner on their longitudinal sides advantageously via metal bands, so-called fins. These fins may even be connected firmly to the tubes during the process for producing the tubes and form a unit with these. The unit formed from a tube and fins is also designated as a finned tube. The fin width influences the introduction of heat into the evaporator or steam generator tubes. The fin width is therefore adapted, preferably as a function of the position of the respective evaporator or steam generator tubes in the continuous-flow steam generator, to a heating profile capable of being predetermined on the fuel-gas side.

In this case, a typical heating profile determined from experimental values or else a rough estimation, such as, for example, a stepped heating profile, may be predetermined as heating profile. By virtue of the suitably selected fin widths, even when different evaporator or steam generator tubes are heated in a widely differing way an introduction of heat into all the evaporator or steam generator tubes can be achieved in such a way that temperature differences of the flow medium at the exit from the evaporator or steam generator tubes are kept particularly low. Premature material fatigue as a result of thermal stresses are reliably prevented in this way. The continuous-flow steam generator consequently has particularly long useful life.

The horizontal gas flue preferably and advantageously has arranged in it a number of superheater heating surfaces which are arranged approximately perpendicularly to the main direction of flow of the fuel gas and the tubes of which are connected in parallel for a throughflow of the flow medium. These superheater heating surfaces, arranged in a suspended form of construction and also designated as bulkhead heating surfaces, are preferably heated predominantly convectively and follow the evaporator tubes of the combustion chamber on the flow-medium side. A particularly beneficial utilization of the fuel-gas heat is thereby ensured.

The vertical gas flue preferably and advantageously has a number of convection heating surfaces which are formed from tubes arranged approximately perpendicularly to the main direction of flow of the fuel gas. These tubes of a convection heating surface are connected in parallel for a throughflow of the flow medium. These convection heating surfaces, too, are preferably heated predominantly convectively.

In order, furthermore, to ensure a particularly full utilization of the heat of the fuel gas, the vertical gas flue advantageously has an economizer.

Advantageously, the burners are preferably arranged on the end wall of the combustion chamber, that is to say on that side wall of the combustion chamber which is located opposite the outflow orifice to the horizontal gas flue. A continuous-flow steam generator designed in this way can be adapted particularly simply to the burnup length of the fossil fuel. By the burnup length of the fossil fuel is to be meant, in this context, the fuel-gas velocity in the horizontal direction at a specific average fuel-gas temperature, multiplied by the burnup time $t_A$ of the flame of the fossil fuel. In this case, the maximum burnup length for the respective continuous-flow steam generator is obtained when the continuous-flow steam generator is under full load with the steam power output M, the so-called full-load mode. The burnup time $t_A$ of the flame of the fossil fuel is, in turn, the time which, for example, a coaldust grain of average size requires in order to burnup completely at a specific average fuel-gas temperature.

In order to keep material damage and undesirable contamination of the horizontal gas flue particularly low, for example due to the introduction of high-temperature molten ash, the length of the combustion chamber, defined by the distance from the end wall to the entry region of the horizontal gas flue, is preferably and advantageously at least equal to the burnup length of the fossil fuel in the full-load mode of the continuous-flow steam generator. This horizontal length of the combustion chamber will generally amount to at least 80% of the height of the combustion chamber, measured from the funnel lop edge, when the lower region of the combustion chamber has a funnel-shaped design, to the combustion chamber ceiling.

For a particularly beneficial utilization of the combustion heat of the fossil fuel, the length L (given in m) of the combustion chamber is preferably and advantageously selected as a function of the steam power output M (given in kg/s) of the continuous-flow steam generator under full load, the burnup time $t_A$ (given in s) of the flame of the fossil fuel and the exit temperature $T_{BRK}$ (given in °C.) of the fuel gas from the combustion chamber. In this case, with a given steam power output M of the continuous-flow steam generator under full load, approximately the higher value of the two functions (I) and (II) applies to the length L of the combustion chamber:

$$L(M, t_A) = (C_1 + C_2 \cdot M) \cdot t_A \quad \text{(I)}$$

and $$L(M, T_{BRK}) = (C_3 \cdot T_{BRK} + C_4)M + C_5(T_{BRK})^2 + C_6 \cdot T_{BRK} + C7 \quad \text{(II)}$$

with $C_1 = 8$ m/s and
$C_2 = 0.0057$ m/kg and
$C_3 = -1.905 \cdot 10^{-4}$ (m · s)/(kg ° C.) and
$C_4 = 0.286$(s · m)/kg and
$C_5 = 3 \cdot 10^{-4}$ m/(° C.)$^2$ and
$C_6 = -0.842$ m/° C. and
$C_7 = 603.41$ m.

By "approximately" is to be meant, in this context, a permissible deviation in the length L of the combustion chamber of +20%/−10% from the value defined by the respective function.

The lower region of the combustion chamber is preferably and advantageously designed as a funnel. In this way, when the continuous-flow steam generator is in operation, ash occurring during the combustion of the fossil fuel can be discharged particularly simply, for example into an ash removal device arranged below the funnel. The fossil fuel may in this case may be coal in solid form.

The advantages achieved by means of the invention include but are not limited to the following. By virtue of some evaporator tubes being led through the combustion chamber before their entry into the containment wall of the combustion chamber, temperature differences in the immediate vicinity of the connection of the combustion chamber to the horizontal gas flue are particularly low when the continuous-flow steam generator is in operation. Consequently, when the continuous-flow steam generator is in operation, the thermal stresses at the connection of the combustion chamber to the horizontal gas flue, which are caused by temperature differences between directly adjacent evaporator tubes of the combustion chamber and steam generator tubes of the horizontal gas flue, remain well below the values at which, for example, there is the risk of tube fractures. The use of a horizontal combustion chamber in a continuous-flow steam generator is therefore possible, even with a comparatively long useful life. Moreover, designing the combustion chamber for an approximately horizontal main direction of flow of the fuel gas affords a particularly compact form of construction of the continuous-flow steam generator.

This, makes it possible, when the continuous-flow steam generator is incorporated into a power station with a steam turbine, to also have particularly short connecting tubes from the continuous-flow steam generator to the steam turbine.

BRIEF DESCRIPTION OF THE DRAWINGS

An exemplary embodiment of the invention is explained in more detail by means of a drawing in which.

Parts corresponding to one another are given the same reference symbols in all the figures.

DETAILED DESCRIPTION OF THE PREFERRED EMBODIMENTS

Figure 1:
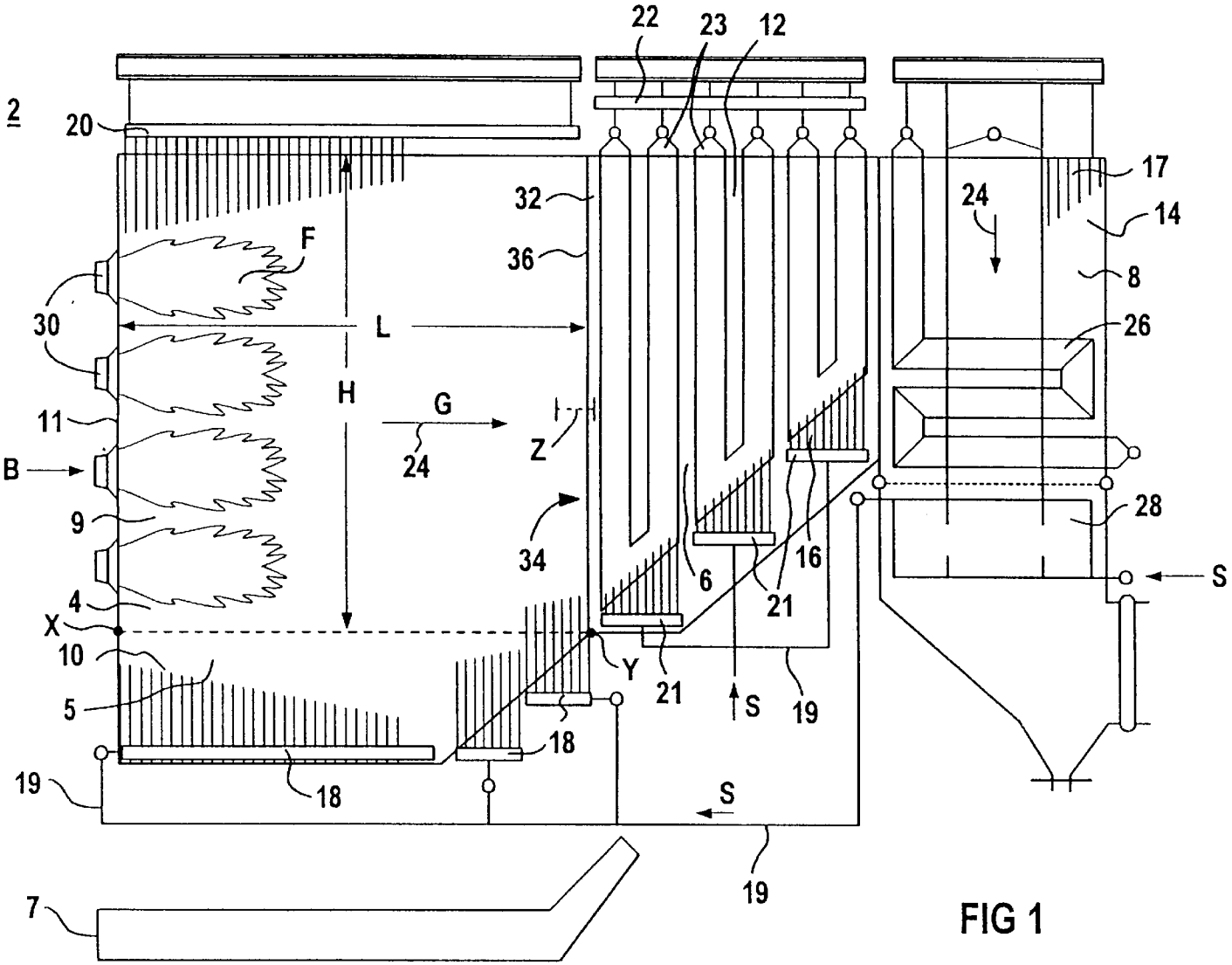
FIG. 1 shows diagrammatically a side view of a fossil-fired continuous-flow steam generator of the double-flue type.

The fossil-fireable continuous-flow steam generator 2 according to FIG. 1 is assigned to a power plant which is not illustrated in any more detail (for the sake of brevity) and which also preferably comprises a steam turbine plant. In this case, the continuous-flow steam generator 2 is preferably designed for a steam power output under full load of at least 80 kg/s.

The steam generated in the continuous-flow steam generator 2 is in this case utilized for driving the steam turbine which itself, in turn, drives a generator for current generation. The current generated by the generator is in this case provided for feeding into an interconnected or island network.

The fossil-fired continuous-flow steam generator 2 comprises a combustion chamber 4 which is designed in a horizontal form of construction and which is followed on the fuel gas side, via a horizontal gas flue 6, by a vertical gas flue 8. The lower region of the combustion chamber 4 is formed by a funnel 5 with a top edge corresponding to the subsidiary line having the end points X and Y. When the continuous-flow steam generator 2 is in operation, ash from the fossil fuel B can be discharged through the funnel 5 into an ash removal device 7 arranged below it. The containment walls 9 of the combustion chamber 4 are formed from vertically arranged evaporator tubes 10 which are welded to one another in a gastight manner and a number N of which are capable of being acted upon in parallel by flow medium S. In this case, one containment wall 9 of the combustion chamber 4 is the end wall 11. In addition, the side walls 12 of the horizontal gas flue 6 and 14 of the vertical gas flue 8 are also formed from vertically arranged steam generator tubes 16 and 17 welded to one another in a gastight manner. At the same time, a number of steam generator tubes 16 and 17 are capable of being acted upon in each case in parallel by flow medium S.

A number of the evaporator tubes 10 of the combustion chamber 4 are, on the flow-medium side, preceded by an entry header system 18 for flow medium S and followed by an exit header system 20. The entry header system 18 comprises in this case a number of parallel entry headers. At the same time, a line system 19 is provided for supplying flow medium S into the entry header system 18 of the evaporator tubes 10. The line system 19 comprises a plurality of parallel-connected lines which are connected in each case to one of the entry headers of the entry header system 18.

In the same way, those steam generator tubes 16 of the side walls 12 of the horizontal gas flue 6 which are capable of being acted upon in parallel by flow medium S are preceded by a common entry header system 21 and followed by a common exit header system 22. In this case, a line system 19 is likewise provided for supplying flow medium S into the entry header system 21 of the steam generator tubes 16. Here, too, the line system comprises a plurality of parallel-connected lines which are connected in each case to one of the entry headers of the entry header system 21.

By virtue of this configuration of the continuous-flow steam generator 2 with entry header systems 18, 21 and exit header systems 20, 22, particularly reliable pressure compensation between the parallel-connected evaporator tubes 10 of the combustion chamber 4 or the parallel-connected steam generator tubes 16 of the horizontal gas flue 6 is possible in that in each case all the parallel-connected evaporator or steam generator tubes 10 and 16 have the same overall pressure loss. This means that, in the case of an evaporator tube 10 or steam generator tube 16 heated to a greater extent, the throughput must rise, as compared with an evaporator tube 10 or steam generator tube 16 heated to a lesser extent.

Figure 2:
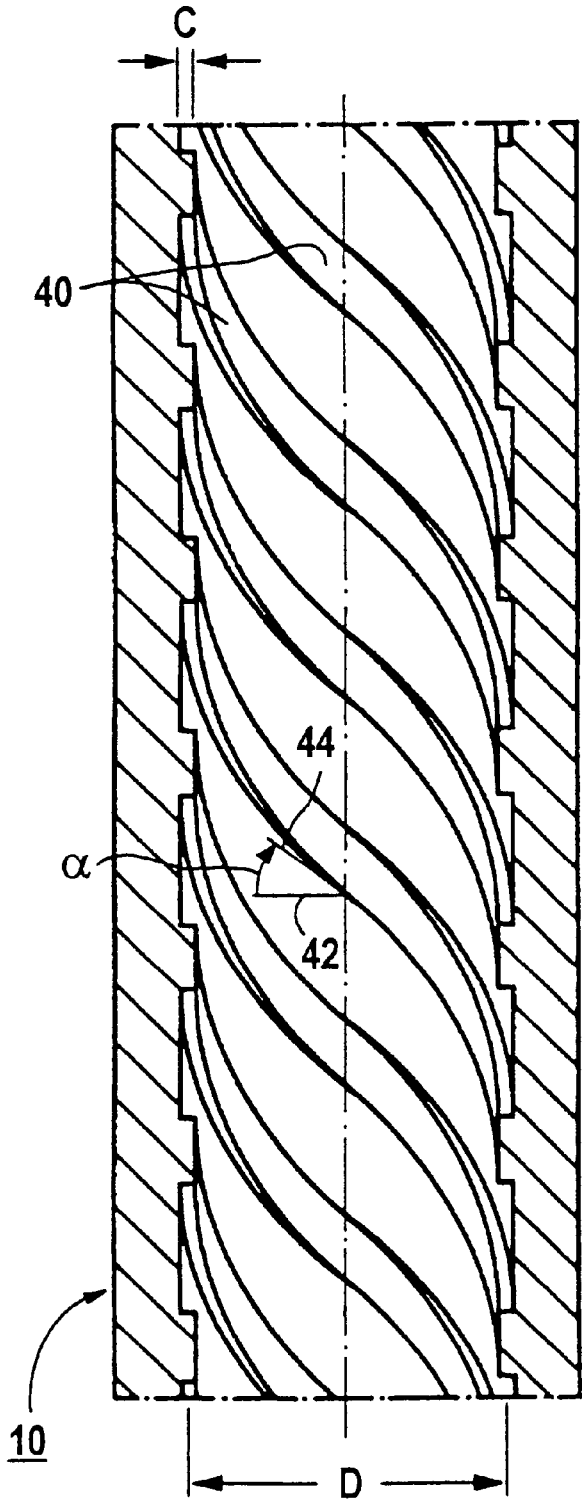
FIG. 2 shows diagrammatically a longitudinal section through an individual evaporator tube.

As illustrated in FIG. 2, the evaporator tubes 10 have a tube inside diameter D and, on their inside, ribs 40 which form a kind of multiflight thread and have a rib height C. In this case, the pitch angle $\alpha$ between a plane 42 perpendicular to the tube axis and the flanks 44 of the ribs 40 arranged on the tube inside is preferably smaller than 55°. As a result, particularly high heat transmission from the inner walls of the evaporator tubes 10 to the flow medium S carried in the evaporator tubes 10 and, at the same time, particularly low temperatures of the tube wall are achieved.

The tube inside diameter D of the evaporator tubes 10 of the combustion chamber 4 is selected as a function of the respective position of the evaporator tubes 10 in the combustion chamber 4. The continuous-flow steam generator 2 is thereby adapted to the differing heating of the evaporator tubes 10. This design of the evaporator tubes 10 of the combustion chamber 4 ensures in a particularly reliable way that temperature differences of the flow medium S upon exit from the evaporator tubes 10 are kept particularly low.

Some of the evaporator tubes 10 are equipped with throttle devices, which are not illustrated in any more detail in the drawing, as means for reducing the throughflow of the flow medium S. The throttle devices are designed as perforated diaphragms reducing the tube inside diameter D at one point and, when the continuous-flow steam generator 2 is in operation, bring about a reduction in the throughput of the flow medium S in evaporator tubes 10 heated to a lesser extent, with the result that the throughput of the flow medium S is adapted to the heating.

Furthermore, one or more lines, not illustrated in any more detail, of the line system 19 are equipped with throttle devices, in particular throttle accoutrements as a means for reducing the throughput of the flow medium S in the evaporator tubes 10.

Adjacent evaporator or steam generator tubes 10, 16, 17 are welded to one another in a gastight manner on their longitudinal sides via fins in a way not illustrated in any more detail in the drawing. To be precise, by a suitable choice of the fin width, the heating of the evaporator or steam generator tubes 10, 16, 17 can be influenced. The respective fin width is therefore adapted to a heating profile which can be predetermined on the fuel-gas side and which depends on the position of the respective evaporator or steam generator tubes 10, 16, 17 in the continuous-flow steam generator 2. In this case, the heating profile may be a typical heating profile determined from experimental values or else a rough estimation. As a result, even when the evaporator or steam generator tubes 10, 16, 17 are heated in a widely differing way, temperature differences at the exit of the evaporator or steam generator tubes 10, 16, 17 are kept particularly low. Material fatigue as a result of thermal stresses are thereby reliably prevented, thus ensuring that the continuous-flow steam generator 2 has a long useful life.

As regards the tubing of the horizontal combustion chamber 4, it must be remembered that the heating of the individual evaporator tubes 10 welded to one another in a gastight manner differs greatly when the continuous-flow steam generator 2 is in operation. The design of the evaporator tubes 10 in terms of their internal ribbing, their fin connection to adjacent evaporator tubes 10 and their tube inside diameter D is therefore selected such that, in spite of different heating, all the evaporator tubes 10 have approximately identical exit temperatures of the flow medium S and a sufficient cooling of all the evaporator tubes 10 for all the operating states of the continuous-flow steam generator 2 is ensured. A heating of some evaporator tubes 10 to a lesser extent when the continuous-flow steam generator 2 is in operation is in this case additionally taken into account by the installation of throttle devices.

The tube inside diameter D of the evaporator tubes 10 in the combustion chamber 4 is selected as a function of their respective position in the combustion chamber 4. Thus, evaporator tubes 10 which are exposed to greater heating when the continuous-flow steam generator 2 is in operation have a larger tube inside diameter D than evaporator tubes 10 which are heated to a lesser extent when the continuous-flow steam generator 2 is in operation. What is achieved thereby, as compared with the situation with identical tube inside diameters, is that the throughput of the flow medium S in the evaporator tubes 10 increases with a larger tube inside diameter D and temperature differences at the exit of the evaporator tubes 10 as a result of different heating are thereby reduced. A further measure for adapting the throughflow of flow medium S through the evaporator tubes 10 to the heating is to install throttle devices in some of the evaporator tubes 10 and/or in the line system 19 provided for the supply of flow medium S. In order, by contrast, to adapt the heating to the throughput of the flow medium S through the evaporator tubes 10, the fin width may be selected as a function of the position of the evaporator tubes 10 in the combustion chamber 4. All the measures mentioned give rise, despite the widely differing heating of the individual evaporator tubes 10, to an approximately identical specific heat adsorption of the flow medium S carried in the evaporator tubes 10 when the continuous-flow steam generator 2 is in operation and therefore to only slight temperature differences of the flow medium S at their exit. The internal ribbing of the evaporator tubes 10 is in this case designed in such a way that, in spite of different heating and throughflow of flow medium S, a particularly reliable cooling of the evaporator tubes 10 is ensured in all the load states of the continuous-flow steam generator 2.

The horizontal gas flue 6 has a number of superheater heating surfaces 23 which are designed as bulkhead heating surfaces and are arranged in a suspended form of construction approximately perpendicularly to the main direction of flow 24 of the fuel gas G and the tubes of which are in each case connected in parallel for a throughflow of the flow medium S. The superheater heating surfaces 23 are heated predominantly convectively and follow the evaporator tubes 10 of the combustion chamber 4 on the flow-medium side.

The vertical gas flue 8 has a number of convection heating surfaces 26 which are capable of being heated predominantly convectively and which are formed from tubes arranged approximately perpendicularly to the main direction of flow 24 of the fuel gas G. These tubes are in each case connected in parallel for a throughflow of the flow medium S. Moreover, an economizer 28 is arranged in the vertical gas flue 8. The vertical gas flue 8 issues on the outlet side into a further heat exchanger, for example into an air preheater, and from there, via a dust filter, into a chimney. The components following the vertical gas flue 8 are not illustrated in any more detail in the drawing.

The continuous-flow steam generator 2 is designed with a horizontal combustion chamber 4 having a particularly low overall height and can therefore be erected at a particularly low outlay in terms of manufacture and assembly. For this purpose, the combustion chamber 4 of the continuous-flow steam generator 2 has a number of burners 30 for fossil fuel B which are arranged, level with the horizontal gas flue 6, on the end wall 11 of the combustion chamber 4. The fossil fuel B may in this case be solid fuels, in particular coal.

So that the fossil fuel B, for example coal in solid form, burns up particularly completely, to achieve particularly high efficiency, and material damage to the first superheater heating surface 23 of the horizontal gas flue 6, as seen on the fuel-gas side, and contamination of said superheater heating surface, for example due to the introduction of high-temperature molten ash, are prevented particularly reliably, the length L of the combustion chamber 4 is selected in such a way that it exceeds, the burnup length of the fossil fuel B when the continuous-flow steam generator 2 is operating in the full-load mode. The length L is in this case the distance from the end wall 11 of the combustion chamber 4 to the entry region 32 of the horizontal gas flue 6. The burnup length of the fossil fuel B is in this case defined as the fuel-gas velocity in the horizontal direction at a specific average fuel-gas temperature, multiplied by the burnup time $t_A$ of the flame F of the fossil fuel B. The maximum burnup length for the respective continuous-flow steam generator 2 is obtained when the respective continuous-flow steam generator 2 is operating under full load. The burnup time $t_A$ of the flame F of the fuel B is, in turn, the time which, for example, a coaldust grain of average size requires to burn up completely at a specific average fuel-gas temperature.

In order to ensure a particularly beneficial utilization of the combustion heat of the fossil fuel B, the length L (given in m) of the combustion chamber 4 is suitably selected as a function of the exit temperature $T_{BRK}$ (given in °C.) of the fuel gas G from the combustion chamber 4, the burnup time $t_A$ (given in s) of the flame F of the fossil fuel B and the steam power output M (given in kg/s) of the continuous-flow steam generator 2 under full load. This horizontal length L of the combustion chamber 4 amounts in this case to at least 80% of the height H of the combustion chamber 4. The height H is in this case measured from the top edge of the funnel 5 of the combustion chamber 4, as marked in FIG. 1 by the subsidiary line having the end points X and Y, to the combustion chamber ceiling. The length L of the combustion chamber 4 is determined approximately via the functions (I) and (II):

$$L(M, t_A) = (C_1 + C_2 \cdot M) \cdot t_A \quad \text{(I)}$$

and $$L(M, T_{BRK}) = (C_3 \cdot T_{BRK} + C_4)M + C_5(T_{BRK})^2 + C_6 \cdot T_{BRK} + C7 \quad \text{(II)}$$

with $C_1 = 8$ m/s and
$C_2 = 0.0057$ m/kg and
$C_3 = -1.905 \cdot 10^{-4}$ (m · s)/(kg ° C.) and
$C_4 = 0.286$ (s · m)/kg and
$C_5 = 3 \cdot 10^{-4}$ m/(° C.)$^2$ and
$C_6 = -0.842$ m/° C. and
$C_7 = 603.41$ m.

What is to be meant here by "approximately" is a permissible deviation of the length L of the combustion chamber 4 of +20%/−10% from the value defined by the respective function. In the design of the continuous-flow steam generator 2 for a predetermined steam power output M of the continuous-flow steam generator 2 under full load, the higher value from the functions (I) and (II) applies in this case to the length L of the combustion chamber 4.

Figure 3:
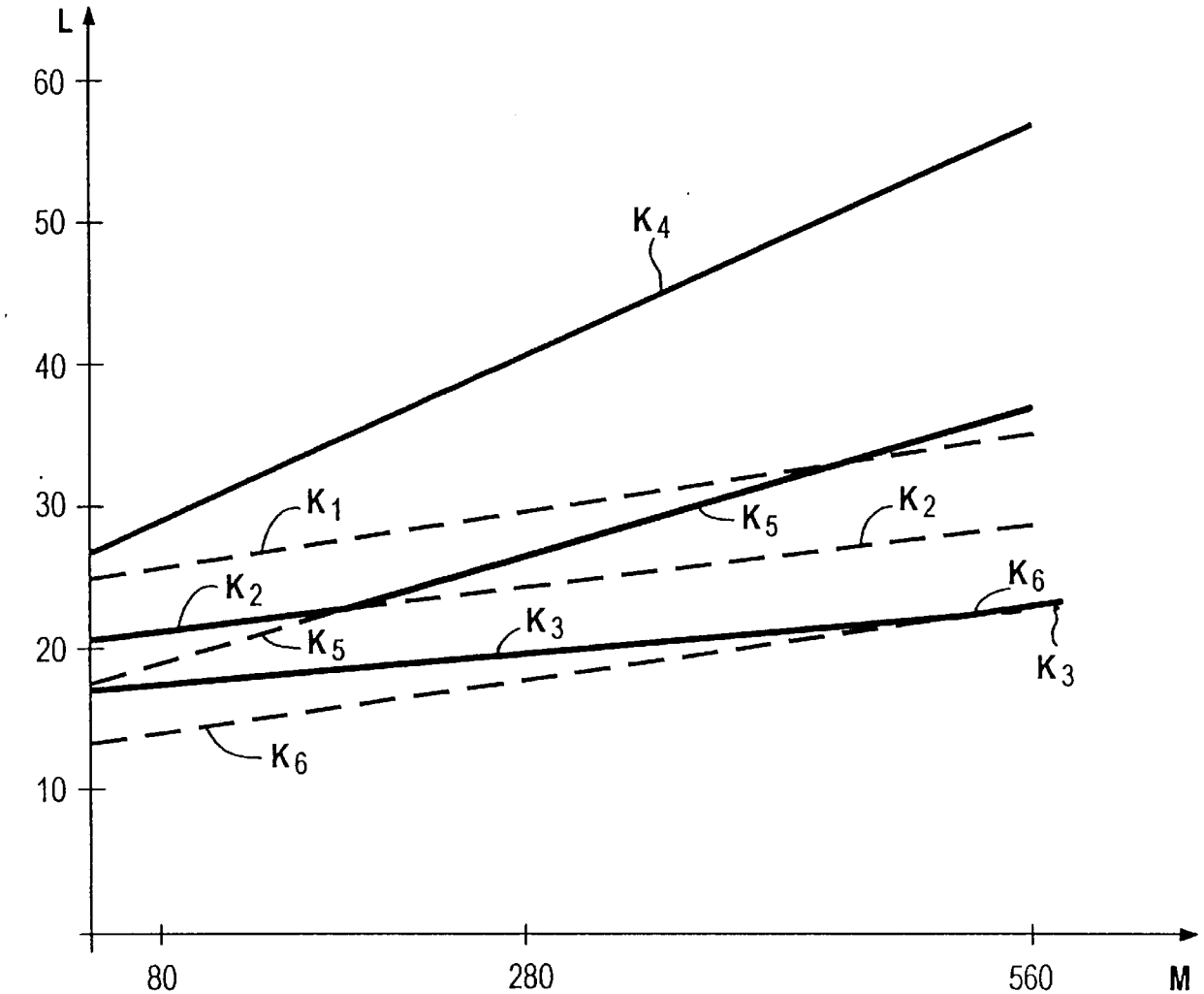
FIG. 3 shows a coordinate system with the curves $K_1$ to $K_6$.

As an example of a possible design of the continuous-flow steam generator 2, six curves $K_1$ to $K_6$ are plotted in the coordinate system according to FIG. 3 for some lengths L of the combustion chamber 4 as a function of the steam power output M of the continuous-flow steam generator 2 under full load. In this case, the curves are in each case assigned the following parameters:

| | |
|---|---|
| $K_1$: $t_A = 3$ s | according to (I), |
| $K_2$: $t_A = 2.5$ s | according to (I), |
| $K_3$: $t_A = 2$ s | according to (I), |
| $K_4$: $T_{BRK} = 1200°$ C. | according to (II), |
| $K_5$: $T_{BRK} = 1300°$ C. | according to (II), |
| $K_6$: $T_{BRK} = 1400°$ C. | according to (II). |

Thus, for example for the burnup time $t_A$=3 s of the flame F of the fossil fuel B and the exit temperature $T_{BRK}$=1200° C. of the fuel gas G from the combustion chamber 4, the curves $K_1$ and $K_4$ are to be used in order to determine the length L of the combustion chamber 4. This results, in the case of a predetermined steam power output M of the continuous-flow steam generator 2 under full load of M=80 kg/s, in a length of L=29 m according to $K_4$, of M=160 kg/s, in a length of L=34 m according to $K_4$, of M=560 kg/s, in a length of L=57 m according to $K_4$.

The curve $K_4$ depicted as an unbroken line therefore always applies.

For example, the curves $K_2$ and $K_5$ are to be used for the burnup time $t_A$=2.5 s of the flame F of the fossil fuel B and the exit temperature of the fuel gas G from the combustion chamber $T_{BRK}$=1300° C. This results, in the case of a predetermined steam power output M of the continuous-flow steam generator 2 under full load of M=80 kg/s, in a length of L=21 m according to $K_2$, of M=180 kg/s, in a length of L=23 m according to $K_2$ and $K_5$, of M=560 kg/s, in a length of L=37 m according to $K_5$.

Up to M=180 kg/s, therefore, that part of the curve $K_2$ which is depicted as an unbroken line applies, not the curve $K_5$ depicted as a broken line in this value range of M. That part of the curve $K_5$ which is depicted as an unbroken line applies to values of M which are higher than 180 kg/s, not the curve $K_2$ depicted as a broken line in this value range of M. The burnup time $t_A$=2 s of the flame F of the fossil fuel B and the exit temperature $T_{BRK}$=1400° C. of the fuel gas G from the combustion chamber 4 are assigned, for example, the curves $K_3$ and $K_6$. This results, in the case of a predetermined steam power output M of the continuous-flow steam generator 2 under full load of M=80 kg/s, in a length of L=18 m according to $K_3$, of M=465 kg/s, in a length of L=21 m according to $K_3$ and $K_6$, of M=560 kg/s, in a length of L=23 m according to $K_6$.

Hence, for values of M up to 465 kg/s, the curve $K_3$ depicted as an unbroken line in this range applies, not the curve $K_6$ depicted as a broken line in this range. The part of the curve $K_6$ depicted as an unbroken line applies to values of M which are higher than 465 kg/s, not the part of the curve $K_3$ depicted as a broken line.

Figure 4:
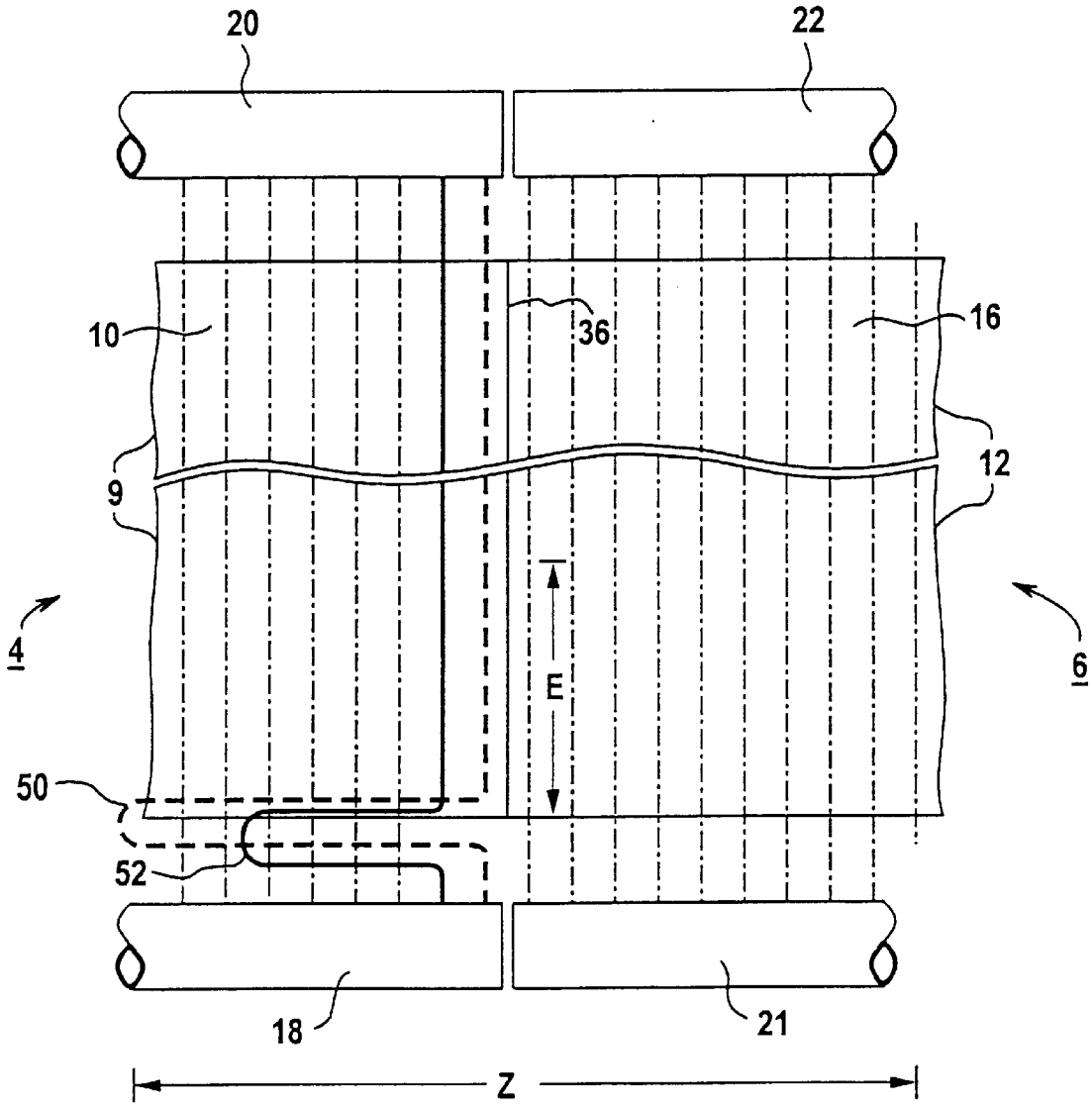
FIG. 4 shows diagrammatically the connection of the combustion chamber to the horizontal gas flue.

So that comparatively small temperature differences arise between the exit region 34 of the combustion chamber 4 and the entry region 32 of the horizontal gas flue 6 when the continuous-flow steam generator 2 is in operation, the evaporator tubes 50 and 52 are led in a special way in the connecting portion Z marked in FIG. 1. This connecting portion Z is illustrated in detail in FIG. 4 and comprises the exit region 34 of the combustion chamber 4 and the entry region 32 of the horizontal gas flue 6. In this case, the evaporator tube 50 is the evaporator tube 50, welded directly to the side wall 12 of the horizontal gas flue 6, of the containment wall 9 of the combustion chamber 4, and the evaporator tube 52 is the evaporator tube 52, directly adjacent to said evaporator tube, of the containment wall 9 of the combustion chamber 4.

These two evaporator tubes 50 and 52 emerge, together with the evaporator tubes 10 connected in parallel to them, from the common entry header system 18. Then, however, both the evaporator tube 50 and the evaporator tube 52 are first led in an approximately horizontal direction, opposite to the main direction of flow 24 of the fuel gas G, outside the combustion chamber 4. They then enter the combustion chamber 4 and do not become an integral part of the containment wall 9 of the combustion chamber 4 directly upon entry into said combustion chamber. To be precise, they are led back in the combustion chamber 4, in the main direction of flow 24 of the fuel gas G, to the region at which they are branched off, outside the combustion chamber 4, from their approximately vertical run, so as to run opposite to the main direction of flow 24 of the fuel gas G. Only after this loop are they welded into the containment wall 9 of the combustion chamber 4, so that they are part of the containment wall 9 of the combustion chamber 4.

By virtue of this special tube routing, when the continuous-flow steam generator 2 is in operation the evaporator tubes 50 and 52 are preheated before they enter the containment wall 9 of the combustion chamber 4. Thus, when the continuous-flow steam generator 2 is in operation, the flow medium S carried in them is heated and therefore preheated, so that it enters the containment wall 9 of the combustion chamber 4 at a comparatively higher temperature than is the case with regard to the evaporator tubes 10 of the combustion chamber 4 which are directly contiguous to the evaporator tubes 50 and 52. As a result of this special tube routing of the evaporator tubes 50 and 52, when the continuous-flow steam generator 2 is in operation the evaporator tubes 50 and 52 in the entry portion E have a comparatively higher temperature than the evaporator tubes 10 of the containment wall 9 of the combustion chamber 4 which are directly adjacent to them. Consequently, when the continuous-flow steam generator 2 is in operation, temperature differences at the connection 36 between the combustion chamber 4 and the horizontal gas flue 6 are kept particularly low in a particularly reliable way.

Figure 5:
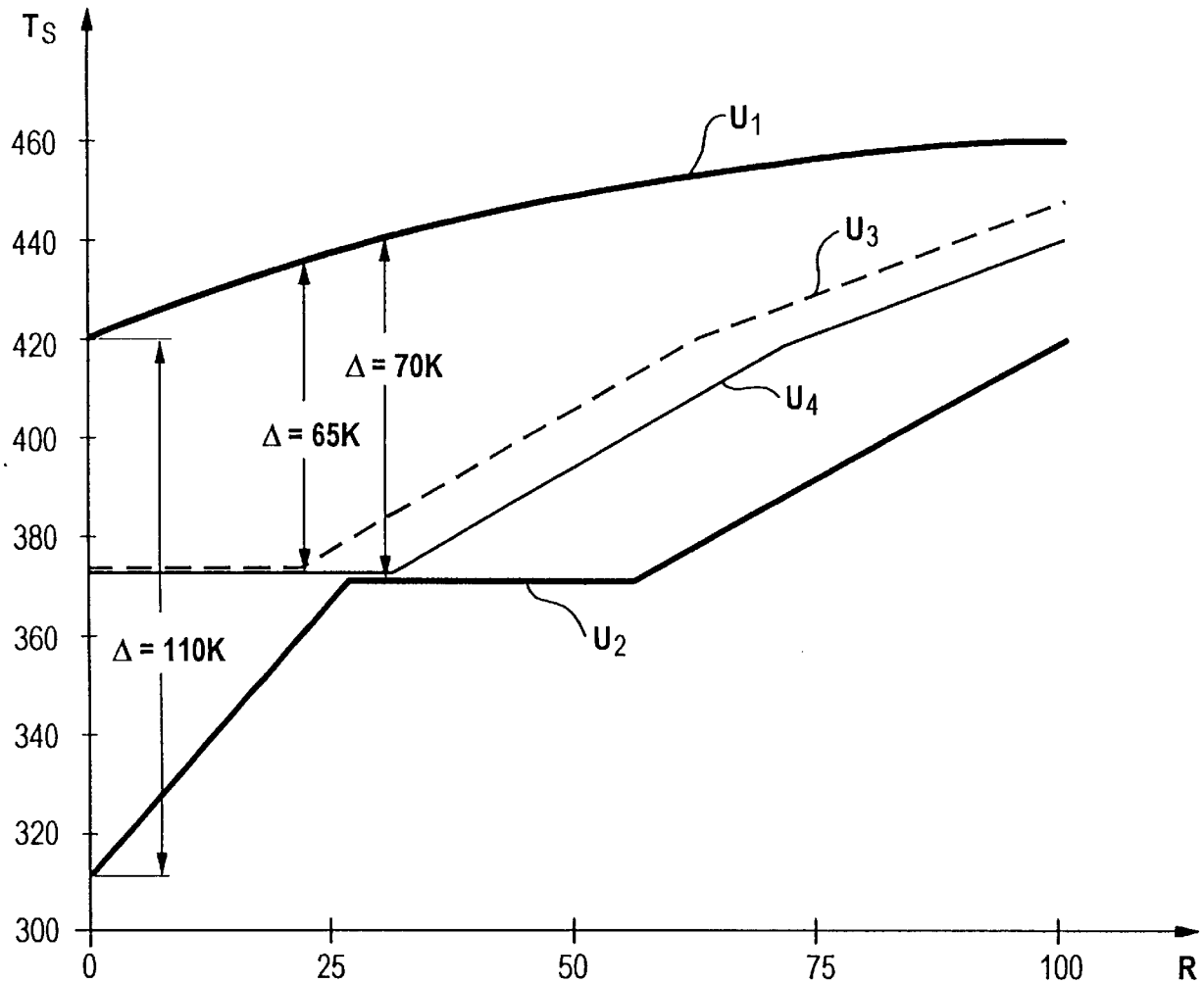
FIG. 5 shows a coordinate system with the curves $U_1$ to $U_4$.

As an example of possible temperatures $T_S$ of the flow medium S in the evaporator tubes 10 of the combustion chamber 4 or the steam generator tubes 16 of the horizontal gas flue 6, the curves $U_1$ to $U_4$ are plotted in a coordinate system according to FIG. 5 for some temperatures $T_S$ (given in °C.) as a function of the relevant tube length R (given in %). In this case, $U_1$ describes the temperature profile of a steam generator tube 16 of the horizontal gas flue 6. By contrast, $U_2$ describes the temperature profile of an evaporator tube 10 along its relative tube length R. $U_3$ describes the temperature profile of the specially routed evaporator tube 50, and $U_4$ describes the temperature profile of the evaporator tube 52 of the containment wall 9 of the combustion chamber 4. It becomes clear from the curves depicted that, due to the special tube routing of the evaporator tubes 50 and 52 in the entry portion E in the containment wall 9 of the combustion chamber 4, the temperature difference in relation to the steam generator tubes 16 of the containment wall 12 of the horizontal gas flue can be markedly reduced. In the example, the temperature of the evaporator tubes 50 and 52 in the entry portion E of the evaporator tubes 50 and 52 can be increased by 45 Kelvin. As a result, when the continuous-flow steam generator 2 is in operation, particularly small temperature differences are ensured in the entry portion E of the evaporator tubes 50 and 52 and the steam generator tubes 16 of the horizontal gas flue 6 at the connection 36 between the combustion chamber 4 and the horizontal gas flue 6.

When the continuous-flow steam generator 2 is in operation, fossil fuel B, preferably coal in solid form, is supplied to the burners 30. The flames F of the burners 30 are in this case oriented horizontally. By virtue of the form of construction of the combustion chamber 4, a flow of the fuel gas G occurring during combustion is generated in the approximately horizontal main direction of flow 24. This fuel gas passes via the horizontal gas flue 6 into the vertical gas flue 8, oriented approximately toward the ground, and leaves this in the direction of the chimney, not illustrated in any more detail.

Flow medium S entering the economizer 28 passes into the entry header system 18 of the evaporator tubes 10 of the combustion chamber 4 of the continuous-flow steam generator 2. In the vertically arranged evaporator tubes 10 of the combustion chamber 4 of the continuous-flow steam generator 2 which are welded to one another in a gastight manner, evaporation and, if appropriate, partial superheating of the flow medium S take place. The steam or a water/steam mixture occurring at the same time is collected in the exit header system 20 for flow medium S. The steam or the water/steam mixture passes from there, via the walls of the horizontal gas flue 6 and of the vertical gas flue 8, into the superheater heating surfaces 23 of the horizontal gas flue 6. Further superheating of the steam takes place in the superheater heating surfaces 23, said steam then being supplied for utilization, for example for driving a steam turbine.

By means of the special routing of the evaporator tubes 50 and 52, when the continuous-flow steam generator is in operation temperature differences between the exit region 34 of the combustion chamber 4 and the entry region 32 of the horizontal gas flue 6 are particularly small. At the same time, a choice of the length L of the combustion chamber 4 as a function of the steam power output M of the continuous-flow steam generator 2 under full load ensures that the combustion heat of the fossil fuel B is utilized particularly reliably. Moreover, due to its particularly small overall height and its compact form of construction, the continuous-flow steam generator 2 can be erected at a particularly low outlay in terms of manufacture and assembly. At the same time, a framework capable of being produced at a comparatively low outlay in technical terms can be provided. In the case of a power plant with a steam turbine and with a continuous-flow steam generator 2 having such a small overhall height, moreover, the connecting tubes from the continuous-flow steam generator to the steam turbine can be designed to be particularly short.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A continuous-flow steam generator with a combustion chamber for fossil fuel which is followed on the fuel-gas side, via a horizontal gas flue, by a vertical gas flue, the combustion chamber comprising:

a plurality of burners arranged approximately level with the horizontal gas flue; and a plurality of vertically arranged evaporator tubes welded to one another in a gastight manner, forming containment walls of the combustion chamber, wherein a plurality of the evaporator tubes are capable of being acted upon in parallel by a flow medium, and wherein, in an exit region of the combustion chamber, a number of the evaporator tubes are capable of being acted upon in parallel by a flow medium being led through the combustion chamber before entry into the respective containment wall of the combustion chamber.

2. The continuous-flow steam generator as claimed in claim 1, wherein side walls of the horizontal gas flue are formed from vertically arranged steam generator tubes welded to one another in a gastight manner, and capable of being acted upon in parallel by a flow medium.

3. The continuous-flow steam generator as claimed in claim 2, wherein side walls of the vertical gas flue are formed from vertically arranged steam generator tubes welded to one another in a gastight manner, and capable of being acted upon in parallel by a flow medium.

4. The continuous-flow steam generator as claimed in claim 2, wherein, a plurality of evaporator tubes capable of being acted upon in parallel by a flow medium are, on the flow-medium side, preceded by a common entry header system and followed by a common exit header system.

5. The continuous-flow steam generator as claimed in claim 2, wherein a plurality of steam generator tubes of at least one of the horizontal gas flue and of the vertical gas flue, which are capable of being acted upon in parallel by a flow medium are, on the flow-medium side, preceded by a common entry header system and followed by a common exit header system.

6. The continuous-flow steam generator as claimed in claim 1, wherein side walls of the vertical gas flue are formed from vertically arranged steam generator tubes welded to one another in a gastight manner, and capable of being acted upon in parallel by a flow medium.

7. The continuous-flow steam generator as claimed in claim 6, wherein, a plurality of evaporator tubes capable of being acted upon in parallel by a flow medium are, on the flow-medium side, preceded by a common entry header system and followed by a common exit header system.

8. The continuous-flow steam generator as claimed in claim 6, wherein a plurality of steam generator tubes of at least one of the horizontal gas flue and of the vertical gas flue, which are capable of being acted upon in parallel by a flow medium are, on the flow-medium side, preceded by a common entry header system and followed by a common exit header system.

9. The continuous-flow steam generator as claimed in claim 1, wherein, a plurality of evaporator tubes capable of being acted upon in parallel by a flow medium are, on the flow-medium side, preceded by a common entry header system and followed by a common exit header system.

10. The continuous-flow steam generator as claimed in claim 1, wherein a plurality of steam generator tubes of at least one of the horizontal gas flue and of the vertical gas flue, which are capable of being acted upon in parallel by a flow medium are, on the flow-medium side, preceded by a common entry header system and followed by a common exit header system.

11. The continuous-flow steam generator as claimed in claim 1, wherein one containment wall of the combustion chamber is an end wall, the evaporator tubes of the end wall being capable of being acted upon in parallel by a flow medium.

12. The continuous-flow steam generator as claimed in claim 11, wherein the evaporator tubes of an end wall of the combustion chamber precede other containment walls of the combustion chamber on the flow-medium side.

13. The continuous-flow steam generator as claimed in claim 1, wherein the evaporator tubes of an end wall of the combustion chamber precede other containment walls of the combustion chamber on the flow-medium side.

14. The continuous-flow steam generator as claimed in claim 1, wherein a tube inside a diameter of a plurality of the evaporator tubes of the combustion chamber is selected as a function of respective positions of the evaporator tubes in the combustion chamber.

15. The continuous-flow steam generator as claimed in claim 1, wherein a plurality of the evaporator tubes include ribs forming a multiflight thread.

16. The continuous-flow steam generator as claimed in claim 15, wherein a pitch angle ($\alpha$) between a plane perpendicular to a tube axis and flanks of the ribs arranged on the inside of the tube, is smaller than about 60°.

17. The continuous-flow steam generator as claimed in claim 15, wherein a pitch angle ($\alpha$) between a plane perpendicular to a tube axis and flanks of the ribs arranged on the inside of the tube, is smaller than about 55°.

18. The continuous-flow steam generator as claimed in claim 1, wherein a plurality of the evaporator tubes include a throttle device.

19. The continuous-flow steam generator as claimed in claim 1, further comprising:

a line system for supplying a flow medium into the evaporator tubes of the combustion chamber, the line system including a plurality of throttle devices for reducing the throughflow of the flow medium.

20. The continuous flow steam generator as claimed in claim 19, wherein the throttle devices are throttle accoutrements.

21. The continuous-flow steam generator as claimed in claim 1, wherein at least one of adjacent evaporator and steam generator tubes are welded to one another in a gastight manner via fins, a fin width being selected as a function of the respective position of the respective evaporator or steam generator tubes in the combustion chamber, of at least one of the horizontal gas flue and of the vertical gas flue.

22. The continuous-flow steam generator as claimed in claim 1, wherein a plurality of superheater heating surfaces are arranged in a suspended form of construction in the horizontal gas flue.

23. The continuous-flow steam generator as claimed in claim 1, wherein a plurality of convection heating surfaces are arranged in the vertical gas flue.

24. The continuous-flow steam generator as claimed in claim 1, wherein the burners are arranged on the end wall of the combustion chamber.

25. The continuous-flow steam generator as claimed in claim 1, wherein a length of the combustion chamber, defined by a distance from the end wall of the combustion chamber to the entry region of the horizontal gas flue, is at least equal to a burnup length of fuel in a full-load mode.

26. The continuous-flow steam generator as claimed in claim 1, wherein a length (L) of the combustion chamber is selected as a function of a steam power output (M) under full load, at least one of a burnup time ($t_A$) of a flame of fuel and an exit temperature ($T_{BRK}$) of fuel gas from the combustion chamber approximately according to the two functions (I) and (II)

$$L(M, t_A) = (C_1 + C_2 \cdot M) \cdot t_A \quad \text{(I)}$$

and $$L(M, T_{BRK}) = (C_3 \cdot T_{BRK} + C_4)M + C_5(T_{BRK})^2 + C_6 \cdot T_{BRK} + C7 \quad \text{(II)}$$

with $C_1 = 8$ m/s and
$C_2 = 0.0057$ m/kg and
$C_3 = -1.905 \cdot 10^{-4}$ (m · s)/(kg ° C.) and
$C_4 = 0.286$ (s · m)/kg and
$C_5 = 3 \cdot 10^{-4}$ m/(° C.)$^2$ and
$C_6 = -0.842$ m/° C. and
$C_7 = 603.41$ m, wherein the relatively higher value of the length (L) of the combustion chamber applies to a predetermined steam power output (M) under full load.

27. The continuous-flow steam generator as claimed in claim 1, wherein a lower region of the combustion chamber is designed as a funnel.

28. The continuous-flow steam generator as claimed in claim 9, wherein a plurality of steam generator tubes of at least one of the horizontal gas flue and of the vertical gas flue, which are capable of being acted upon in parallel by a flow medium are, on the flow-medium side, preceded by a common entry header system and followed by a common exit header system.

29. A continuous-flow steam generator, comprising:

a combustion chamber; and at least one gas flue, wherein the combustion chamber includes, a plurality of substantially vertically oriented evaporator tubes forming a containment wall of the combustion chamber, wherein, in an exit region of the combustion chamber, a plurality of the evaporator tubes are branched off in a substantially horizontal direction into the combustion chamber, prior to forming a containment wall of the combustion chamber.

30. The continuous-flow steam generator of claim 29, wherein the plurality of branched off evaporator tubes are preheated prior to forming a containment wall of the combustion chamber.

31. The continuous-flow steam generator of claim 29, wherein the evaporator tubes are capable of being acted upon in parallel by a flow medium flowing through the combustion chamber.

32. The continuous-flow steam generator of claim 29, wherein the substantially vertically oriented evaporator tubes forming a containment wall are welded to one another in a gastight manner.

33. The continuous-flow steam generator of claim 29, wherein the combustion chamber further includes a plurality of burners arranged approximately level with the at least one gas flue.

* * * * *